US009972918B2

(12) United States Patent
Lin et al.

(10) Patent No.: US 9,972,918 B2
(45) Date of Patent: May 15, 2018

(54) DUAL-FREQUENCY DUAL-POLARIZED BASE STATION ANTENNA FOR PARALLEL DUAL FEEDING

(71) Applicants: JIANGSU HENGXIN TECHONOLOGY LIMITED CORPORATION, Dingshu Yixing, Jiangsu (CN); UNIVERSITY OF ELECTRONIC SCIENCE AND TECHNOLOGY, Chengdu, Sichuan (CN)

(72) Inventors: Xianqi Lin, Sichuan (CN); Jin Zhang, Sichuan (CN); Yuan Jiang, Sichuan (CN); Liying Nie, Sichuan (CN); Zhe Chen, Sichuan (CN); Zhonghua Liu, Jiangsu (CN); Yanping Hua, Jiangsu (CN); Jiawei Yu, Sichuan (CN)

(73) Assignee: JIANGSU HENGXIN TECHNOLOGY LIMITED CORPORATION, Yixing, Jiangsu (CN)

( * ) Notice: Subject to any disclaimer, the term of this patent is extended or adjusted under 35 U.S.C. 154(b) by 35 days.

(21) Appl. No.: 15/310,432

(22) PCT Filed: May 5, 2015

(86) PCT No.: PCT/CN2015/000310
§ 371 (c)(1),
(2) Date: Nov. 10, 2016

(87) PCT Pub. No.: WO2016/168951
PCT Pub. Date: Oct. 27, 2016

(65) Prior Publication Data

US 2017/0077614 A1 Mar. 16, 2017

(30) Foreign Application Priority Data

Apr. 18, 2015 (CN) ..... 2015 1 0188850

(51) Int. Cl.
*H01Q 9/04* (2006.01)
*H01Q 21/24* (2006.01)
(Continued)

(52) U.S. Cl.
CPC ..... *H01Q 21/24* (2013.01); *H01Q 1/246* (2013.01); *H01Q 1/36* (2013.01); *H01Q 1/38* (2013.01); *H01Q 5/335* (2015.01); *H01Q 9/045* (2013.01)

(58) Field of Classification Search
CPC ..... H01Q 21/24; H01Q 5/307; H01Q 1/246; H01Q 1/36; H01Q 1/38; H01Q 9/04; H01Q 19/005
(Continued)

(56) References Cited

U.S. PATENT DOCUMENTS

2002/0163468 A1* 11/2002 Anderson ..... H01Q 9/0428 343/700 MS
2012/0038526 A1* 2/2012 Lim ..... H01Q 1/3275 343/713
2015/0236424 A1* 8/2015 Panther ..... H01Q 9/0435 343/700 MS

* cited by examiner

*Primary Examiner* — Dameon E Levi
*Assistant Examiner* — Hasan Islam

(57) ABSTRACT

The present invention relates to a parallel-feeding, dual-band and dual-polarized base station antenna comprising a radiating patch layer, four F-shaped metal strips which are perpendicular to the radiating patch layer and orthogonal to each other, and a feeding layer, which is sequentially disposed from top to bottom, wherein the radiating patch layer comprises the first metal covering layer and the first dielectric layer; wherein the first metal covering layer is square-shaped and an isosceles triangle having the same size is cut from each corner of the square; wherein the four F-shaped metal strips work as the extended part of the feeding layer to couple-feed the radiating patch layer; the feeding layer comprises the first metal feed-line layer, the second dielec-
(Continued)

tric layer, the metal floor layer, the third dielectric layer and the second metal feed-line layer, which are sequentially disposed from top to bottom.

3 Claims, 2 Drawing Sheets

(51) Int. Cl.
*H01Q 5/335* (2015.01)
*H01Q 1/24* (2006.01)
*H01Q 1/36* (2006.01)
*H01Q 1/38* (2006.01)
(58) Field of Classification Search
USPC ..... 343/700 MS, 846
See application file for complete search history.

DUAL-FREQUENCY DUAL-POLARIZED BASE STATION ANTENNA FOR PARALLEL DUAL FEEDING

TECHNICAL FIELD OF THE INVENTION

The present invention relates to the field of antenna technology, and more particularly, to a parallel-feeding, dual-band and dual-polarized base station antenna.

BACKGROUND OF THE INVENTION

With the popularity of mobile communication equipment, the demand for an improved mobile base station design that is compatible with various communication protocols, economization of base station constructing resources, small size and easily concealed, etc. To occupy a larger part of the base station, the antenna must have a smaller design and be compatible with various communication frequency bands, as well as to realize the polarization isolation of transmitting and receiving signals on the same antenna, etc.

To achieve the above purpose, the base station design requires a certain working bandwidth, a wider wave beam, a better front-to-rear ratio, ±45° dual-polarization, and a cross-polarization inhibitor. Meanwhile, in order to reduce the interference between signal transmission and reception, a high enough isolation degree is required between the two cross-polarization ports of the antenna. In the prior art, two cross-positioned dipoles are usually adopted in the design of the base station antenna because the dipole antenna has an omnidirectional diagram and wider bandwidth. However, the dipole antenna can only work properly in a quarter-wavelength distance from the metal reflector, limiting the working bandwidth. Designing a smaller antenna is difficult in this arrangement. Additionally, the traditional design of the base station antenna adopts a patch antenna. Compared with the dipole antenna, the patch antenna is a low-profile antenna, which can satisfy the requirement of a small-sized system. To improve the isolation degree of a dual-polarized feeding port, the patch antenna adopts balanced-feed way, which requires a complicated design of broadband 180° phase shifter in the feeding network, increasing the difficulty and cost. In conclusion, the shortcomings of traditional base station antennas create urgent problems that need to be solved for those skilled in this field.

SUMMARY OF THE INVENTION

The purpose of the present invention is to provide a parallel-feeding, dual-band and dual-polarized base station antenna, solving the disadvantages of a large base station antenna, complicated feeding network and limited bandwidth in the prior art.

To achieve the above purpose, the present invention adopts the following technical solution: A parallel-feeding, dual-band and dual-polarized base station antenna, comprising a radiating patch layer and four F-shaped metal strips which are perpendicular to the radiating patch layer and orthogonal to each other. The present device also comprises a feeding layer, which are sequentially disposed from top to bottom, wherein the radiating patch layer comprises a first metal covering layer and a first dielectric layer. The first metal covering layer is square-shaped and an isosceles triangle having the same size is cut from each corner of the square. The four F-shaped metal strips work as the extended part of the feeding layer to couple-feed the radiating patch layer, wherein the feeding layer comprises a first metal feed-line layer, a second dielectric layer, a metal floor layer, a third dielectric layer, and a second metal feed-line layer, which are sequentially disposed from top to bottom.

In another embodiment of the parallel-feeding, dual-band and dual-polarized base station, the four Γ-shaped metal strips, the first Γ-shaped metal strip, the second Γ-shaped metal strip, the third Γ-shaped metal strip, and the fourth Γ-shaped metal strip are respectively connected to the feeding layer through the first cylindrical metal probe, the second cylindrical metal probe, the third cylindrical metal probe and the fourth cylindrical metal probe. The first Γ-shaped metal strip and the third Γ-shaped metal strip are on the same plane. The second Γ-shaped metal strip and the fourth Γ-shaped metal strip are on the same plane. The above two planes are perpendicular to each other, wherein one edge of the Γ-shaped metal strip, which is parallel to the metal floor layer, maintains a certain distance from the radiating patch layer.

Further, the center of the second dielectric layer is a big square and the center of two adjacent edges of the big square are extended to form a small square respectively.

The third dielectric layer is the same shape as the second dielectric layer, and the third dielectric layer is correspondingly disposed underneath the second dielectric layer.

The metal floor layer is square-shaped and the area of the metal floor layer is the same as that of the big square in the center of the second dielectric layer.

The first metal feed-line layer comprises the first feed-line and the second feed-line, wherein the length of the first feed-line is equal to that of the second feed-line. The head end of the first feed-line and the second feed-line are respectively located in the two small squares of the second dielectric layer, wherein the second metal feed-line layer comprises the third feed-line and the fourth feed-line. The length of the third feed-line is equal to that of the fourth feed-line, and the head end of the third feed-line and that of the fourth feed-line are respectively located in the two small squares of the third dielectric layer.

The head end of the third feed-line is correspondingly disposed underneath that of the first feed-line; a portion of the third feed-line, which is extended to the area of the big square, is disposed center-symmetrically to that of the first feed-line. The head end of the fourth feed-line is correspondingly disposed underneath the second feed-line; a portion of the fourth feed-line, which is extended to the area of the big square, is disposed center-symmetrically to that of the second feed-line.

The first feed-line connected to the first cylindrical metal probe is also connected to the first Γ-shaped metal strip. The third feed-line connected to the third cylindrical metal probe is also connected to the third Γ-shaped metal strip.

The second feed-line is connected to the second cylindrical metal probe then further connected to the second Γ-shaped metal strip; the fourth feed-line is connected to the fourth cylindrical metal probe then further connected to the fourth Γ-shaped metal strip.

Compared with the prior art, the present invention offers the advantages of a small-sized base station antenna, simple feeding network and wider bandwidth.

MARKING INSTRUCTIONS OF THE DRAWINGS

Figure 1:
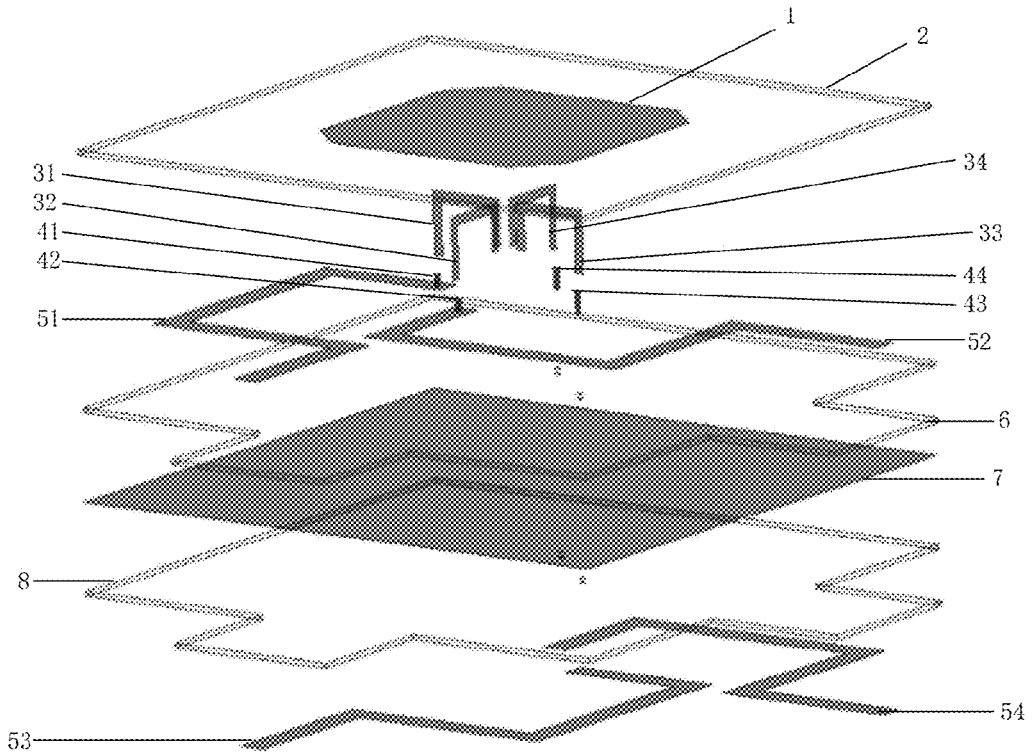
FIG. 1 is an expanded structure diagram of the antenna of the present invention.

1. The First Metal Covering Layer, 2. The First Dielectric Layer, 6. The Second Dielectric Layer, 7. Metal Floor Layer, 8. The Third Dielectric Layer, 31. The First Γ-shaped Metal Strip, 32. The Second Γ-shaped Metal Strip, 33. The Third Γ-shaped Metal Strip, 34. The Fourth Γ-shaped Metal Strip, 41. The First Cylindrical Metal Probe, 42. The Second Cylindrical Metal Probe, 43. The Third Cylindrical Metal Probe, 44. The Fourth Cylindrical Metal Probe, 51. The First Feed-line, 52. The Second Feed-line, 53. The Third Feed-line, 54. The Fourth Feed-line

DETAILED DESCRIPTION OF THE INVENTION

Drawings and detailed embodiments are combined hereinafter to elaborate the technical principles of the present invention.

As shown in FIGS. 1-4, a parallel-feeding, dual-band and dual-polarized base station antenna comprises a radiating patch layer, four Γ-shaped metal strips which are perpendicular to the radiating patch layer and orthogonal to each other, and a feeding layer, which is sequentially disposed from top to bottom. The radiating patch layer comprises the first metal covering layer 1 and the first dielectric layer 2, wherein the first metal covering layer 1 is square-shaped; and, an isosceles triangle having the same size is cut from each corner of the square. The four Γ-shaped metal strips work as the extended part of the feeding layer to couple-feed the radiating patch layer. The feeding layer comprises the first metal feed-line layer, the second dielectric layer 2, the metal floor layer 7, the third dielectric layer 8 and the second metal feed-line layer, which is sequentially disposed from top to bottom. Within the four Γ-shaped metal strips, the first Γ-shaped metal strip 31, the second Γ-shaped metal strip 32, the third Γ-shaped metal strip 33 and the fourth Γ-shaped metal strip 34 are respectively connected to the feeding layer through the first cylindrical metal probe 41, the second cylindrical metal probe 42, the third cylindrical metal probe 43 and the fourth cylindrical metal probe 44. The first Γ-shaped metal strip 31 and the third Γ-shaped metal strip 33 are on the same plane; the second Γ-shaped metal strip 32 and the fourth Γ-shaped metal strip 34 are on the same plane; the above two planes are perpendicular to each other; one edge of the Γ-shaped metal strip, which is parallel to the metal floor layer 7, keeps a certain distance from the radiating patch layer. The center of the second dielectric layer 6 is a big square, and the center of two adjacent edges of the big square are extended to form a small square respectively. The third dielectric layer 8 is the same shape as the second dielectric layer 6, and the third dielectric layer is correspondingly disposed underneath the second dielectric layer. The metal floor layer 7 is square-shaped and the area of the metal floor layer 7 is same as that of the big square in the center of the second dielectric layer 6. The first metal feed-line layer comprises the first feed-line 51 and the second feed-line 52. The length of the first feed-line 51 is equal to that of the second feed-line 52. The head end of the first feed-line 51 and the head of the second feed-line 52 are respectively located in the two small squares of the second dielectric layer 6. The second metal feed-line layer comprises the third feed-line 53 and the fourth feed-line 54. The length of the third feed-line 53 is equal to that of the fourth feed-line 54. The head end of the third feed-line 53 and that of the fourth feed-line 54 are respectively located in the two small squares of the third dielectric layer 8. The head end of the third feed-line 53 is correspondingly disposed underneath the first feed-line 51. A portion of the third feed-line 53, which is extended to the area of the big square, is disposed center-symmetrically to that of the first feed-line 51. The head end of the fourth feed-line 54 is correspondingly disposed underneath that of the second feed-line 52; and, a portion of the fourth feed-line 54, which is extended to the area of the big square, is disposed center-symmetrically to that of the second feed-line 52. The first feed-line 51 is connected to the first cylindrical metal probe 41 and to the first Γ-shaped metal strip 31; the third feed-line 53 is connected to the third cylindrical metal probe 43 and to the third Γ-shaped metal strip 33; the second feed-line 52 is connected to the second cylindrical metal probe 42 and to the second Γ-shaped metal strip 32; the fourth feed-line 54 is connected to the fourth cylindrical metal probe 44 and to the fourth Γ-shaped metal strip 34.

The third feed-line 53 is correspondingly disposed underneath the first feed-line 51, forming two parallel lines in the small square area, which is the first feeding port of the antenna. The fourth feed-line 54 is correspondingly disposed underneath the second feed-line 52, forming two parallel lines in the small square area, which is the second feeding port of the antenna. When the four feed-lines enter the area of the big square in center, the two parallel lines transfer into micro-strip lines due to the existence of the metal floor layer 7. The above four feed-lines are respectively connected to the four cylindrical metal probes and also connected to the Γ-shaped metal strips so as to feed the radiating patch. The third cylindrical metal probe 43 and the fourth cylindrical metal probe 44 extend from the bottom to the top throughout the third dielectric layer 8, the metal floor layer 7 and the second dielectric layer 6 without touching the metal floor layer 7.

A portion of the third feed-line 53, which goes through the area of the small squares of the second dielectric layer and the third dielectric layer, is correspondingly disposed under the first feed-line 51, forming two parallel lines. The first feed-line 51 and the third feed-line 53 form two micro-strip transmission lines with the metal floor layer 7, respectively. The difference between the current phase of the two micro-strip transmission lines is 180° in a sufficiently broad frequency band; the first feed-line 51 is connected to the first cylindrical metal probe 41, then further connected to the first Γ-shaped metal strip 31. Meanwhile, the third feed-line 53 is connected to the third cylindrical metal probe 43, then further connected to the third Γ-shaped metal strip 33. Consequently, the first Γ-shaped metal strip 31 and the third Γ-shaped metal strip 33 can feed the radiating patch layer in the opposite phase. Similarly, the second Γ-shaped metal strip 32 and the fourth Γ-shaped metal strip 34 can feed the radiating patch layer in the opposite phase. The first Γ-shaped metal strip and the third Γ-shaped metal strip are orthogonally polarized with the second Γ-shaped metal strip and the fourth Γ-shaped metal strip, realizing the dual-polarized working of the antenna. Meanwhile, the electromagnetic coupling of the first Γ-shaped metal strip and the third Γ-shaped metal strip is in opposite phase with that of the second Γ-shaped metal strip and the fourth Γ-shaped metal strip so that the cross-polarization interference from the first Γ-shaped metal strip and the third Γ-shaped metal strip in the second feeding port can be counteracted. Similarly, the cross-polarization interference from the second Γ-shaped metal strip and the fourth Γ-shaped metal strip in the first feeding port can be counteracted. Consequently, the cross-polarization interference of the antenna can be very low. Additionally, the cutting treatment of the four corners of the big square in the radiating patch layer and the coupled feeding of the Γ-shaped metal strips enable the antenna to obtain better matching and wider bandwidth in two frequency bands.

Figure 2:
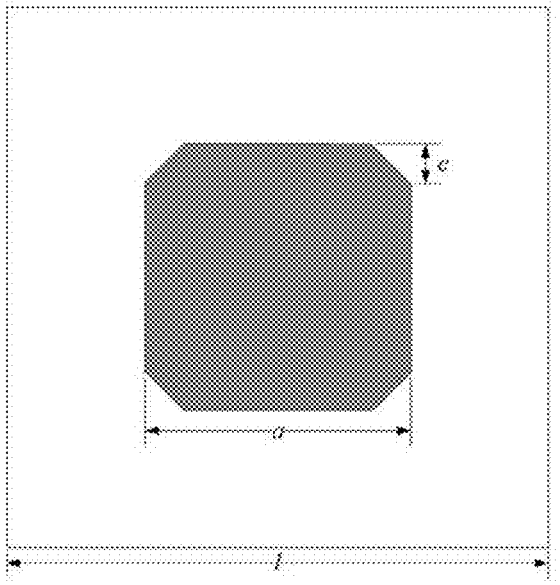
FIG. 2 is a schematic diagram of the patch.
Figure 3:
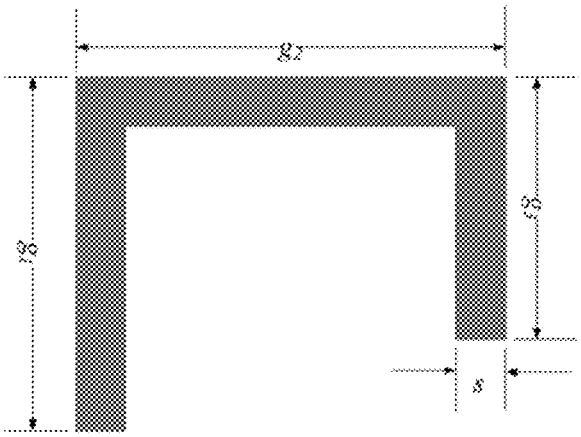
FIG. 3 is a structure diagram of the Γ-shaped metal strip.
Figure 4:
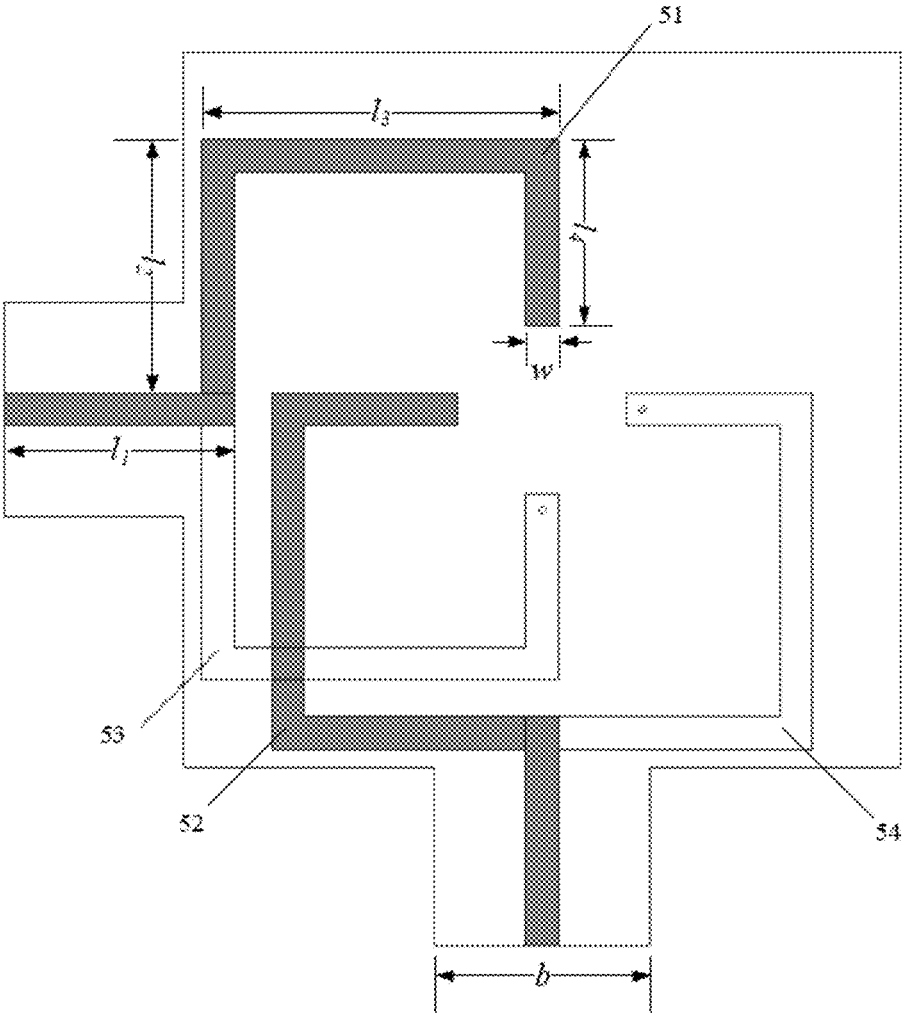
FIG. 4 is a schematic diagram of the feed-line.

To further elaborate the practicality of the above technical solution, a detailed design is provided hereinafter. A parallel-feeding, dual-band and dual-polarized base station antenna, as shown in FIGS. 2 and 3, of which the designed low-frequency channel works in TD-LTE Band 39 (1.88-1.92 GHz) and the high-frequency channel works in TD-LTE Band 41 (2.469-2.69 GHz). The dielectric substrate is comprised of the F4B substrate with a thickness of 0.8 mm and a dielectric constant of 2.55. The geometric parameter values of the corresponding antenna are: a=49 mm, b=25 mm, c=7 mm, l=100 mm, $l_1$=32 mm, $l_2$=35.5 mm, $l_3$=49.75 mm, $l_4$=26 mm, w=4.5 mm, $g_1$=10.8 mm, $g_2$=13 mm, $g_3$=8.014 mm, s=1.5 mm. A simulation shows that the two working frequency bands of the antenna are 1.87-2.01 GHz and 2.47-2.7 GHz respectively, and the two corresponding frequency bands are 140 MHz and 230 MHz respectively; the isolation degree in the transmission band is higher than 25 dB and the cross-polarization is less than −15 dB. The actual transmission gain of the center frequency 1.94 GHz and 2.59 GHz is 8.12 dB and 9.62 dB, respectively.

The present invention can be utilized in a TD-LTE mobile communication base station, having the advantages of dual-frequency, broadband, dual-polarization, low cross-polarization and high isolation degree, which are applicable to the system. Meanwhile, the present invention has a compact structure, reduced manufacturing cost, and comparatively simple manufacturing process.

Further, the present invention is characterized by the following benefits:

(1) Compared with the traditional base station antenna, the present invention is dual-frequency working. On the one hand, the bandwidth can be widened by cutting the corners of the patch. On the other hand, the frequency ratio of two frequency bands can be controlled through adjusting the coupling between the Γ-shaped metal strips and the radiating patch.

(2) Compared with the traditional balanced feeding way, the feeding structure of the present invention is simpler and the bandwidth is wider. The present invention utilizes the current in two parallel lines in an opposite direction so as to transfer the two parallel lines into micro-strip lines, obtaining a low phase error 180° phase shift feeding network skillfully.

(3) The base station antenna of the present invention is a small-sized and low-profile antenna. The design of the present invention adopts a patch antenna requiring no installation height. Therefore, the patch has to be lifted up to achieve a required working bandwidth. In the present invention, the height of the patch can be decreased by the broadband matching effect of the Γ-shaped metal strips.

(4) The base station of the present invention is manufactured by printed-circuit board technology, whereas the traditional base station adopts a more cumbersome mechanical processing method. Thus, the antenna of the present invention has advantages of low cost, low weight, short processing cycle, and easy integration.

The previous descriptions are of preferred examples for implementing the invention, and the scope of the invention should not necessarily be limited by this description. The scope of the present invention is defined by the claims.

The invention claimed is:

1. A parallel-feeding, dual-band and dual-polarized base station antenna, comprising:

a radiating patch layer, four Γ-shaped metal strips which are perpendicular to the radiating patch layer and orthogonal to each other, and a feeding layer;

wherein the radiating patch layer comprises a first metal covering layer and a first dielectric layer, wherein the first metal covering layer is square-shaped and an isosceles triangle having the same size is cut from each corner of the square, wherein the four r-shaped metal strips respectively work as extended parts of the feeding layer to couple-feed the radiating patch layer; wherein the feeding layer comprises a first metal feed-line layer, a second dielectric layer, a metal floor layer, a third dielectric layer, and a second metal feed-line layer; and wherein the radiating patch layer, the four Γ-shaped metal strips and the feeding layer are sequentially disposed from top to bottom.

2. The parallel-feeding, dual-band and dual-polarized base station antenna of claim 1, wherein a first Γ-shaped metal strip, a second Γ-shaped metal strip, a third Γ-shaped metal strip, and a fourth Γ-shaped metal strip are respectively connected to the feeding layer through a first cylindrical metal probe, a second cylindrical metal probe, a third cylindrical metal probe, and a fourth cylindrical metal probe;

wherein the first Γ-shaped metal strip and the third Γ-shaped metal strip are on a first plane, wherein the second Γ-shaped metal strip and the fourth Γ-shaped metal strip are on a second plane, wherein the two planes are perpendicular to each other; and wherein one edge of the respective Γ-shaped metal strips is parallel to the metal floor layer, and maintains a certain distance from the radiating patch layer.

3. The parallel-feeding, dual-band and dual-polarized base station antenna of claim 2, wherein the center of the second dielectric layer is a big square and the center of two adjacent edges of the big square are extended to form a small square respectively, wherein the third dielectric layer is the same shape as the second dielectric layer, and the third dielectric layer is correspondingly disposed underneath the second dielectric layer;

wherein the metal floor layer is square-shaped and the area of the metal floor layer is same as that of the big square in the center of the second dielectric layer;

wherein the first metal feed-line layer comprises a first feed-line and a second feed-line, wherein the length of the first feed-line is equal to that of the second feed-line, wherein a head end of the first feed-line and the second feed-line are respectively located in the two small squares of the second dielectric layer, wherein the second metal feed-line layer comprises a third feed-line and a fourth feed-line, wherein the length of the third feed-line is equal to that of the fourth feed-line, wherein a head end of the third feed-line and that of the fourth feed-line are respectively located in the two small squares of the third dielectric layer, wherein a head end of the third feed-line is correspondingly disposed underneath that of the first feed-line, wherein a portion of the third feed-line, which is extended to the area of the big square, is disposed center-symmetrically to that of the first feed-line, wherein the head end of the fourth feed-line is correspondingly disposed underneath the second feed-line, wherein a portion of the fourth feed-line, which is extended to the area of the big square, is disposed center-symmetrically to that of the second feed-line;

wherein the first feed-line is connected to the first cylindrical metal probe and to the first Γ-shaped metal strip, wherein the third feed-line is connected to the third cylindrical metal probe and to the third Γ-shaped metal strip, wherein the second feed-line is connected to the second cylindrical metal probe and to the second Γ-shaped metal strip, and wherein the fourth feed-line connected to the fourth cylindrical metal probe is also connected to the fourth Γ-shaped metal strip.

* * * * *